US005470271A

United States Patent [19]

Briggs et al.

[11] Patent Number: 5,470,271

[45] Date of Patent: Nov. 28, 1995

[54] FLEXIBLE BELT RECLAIMING

[75] Inventors: David R. Briggs, Rochester; Erwin E. Proseus, Marian; Frances Tracey, Pittsford; William G. Herbert, Williamson; Gary J. Bach, Bloomfield; Charles A. Hutchinson, Rochester; Alan L. Dudley, Ontario; Wayne F. Riker, Williamson; Willie McFadden, Jr., Penfield; Peter J. Schmitt, Ontario; Henry T. Mastalski, Webster, all of N.Y.

[73] Assignee: Xerox Corporation, Stamford, Conn.

[21] Appl. No.: 259,364

[22] Filed: Jun. 14, 1994

Related U.S. Application Data

[63] Continuation of Ser. No. 815,795, Jan. 2, 1992, abandoned.

[51] Int. Cl.[6] ..... B24B 27/033

[52] U.S. Cl. ..... 451/55; 451/39; 451/53; 451/59

[58] Field of Search ..... 451/55, 38, 39, 451/53, 397, 59, 165

[56] References Cited

U.S. PATENT DOCUMENTS

| | | | |
|---|---|---|---|
| 3,552,848 | 1/1971 | Van Wagner | 355/211 |
| 3,699,726 | 10/1972 | Turner | 51/319 |
| 3,815,295 | 6/1974 | Lanker | 51/328 |
| 3,837,815 | 9/1974 | Bixby | 23/293 R |
| 3,959,934 | 6/1976 | Byrne | 51/283 |
| 3,990,907 | 11/1976 | Endo et al. | 134/2 |
| 4,501,621 | 2/1985 | Abe et al. | 134/17 |
| 4,772,527 | 9/1988 | Karaishi | 430/125 |
| 5,148,639 | 9/1992 | Sakai et al. | 51/328 |

FOREIGN PATENT DOCUMENTS

| | | | |
|---|---|---|---|
| 0514173 | 6/1955 | Canada | 51/319 |
| 0026179 | 2/1982 | Japan | 51/319 |

*Primary Examiner*—Robert A. Rose

[57] ABSTRACT

A separation process including providing a flexible belt photoreceptor comprising a photoconductive layer on the outer surface of a flexible metal belt substrate, the photoconductive layer including amorphous selenium or selenium alloy, transporting the substrate through an arcuate path having a small radius of curvature to apply stress to the photoconductive layer, and abrasively removing substantially all of the selenium or selenium alloy remaining on the substrate. This process may be carried out in an apparatus which includes at least one member having an arcuate surface with a small radius of curvature, means to transport the belt photoreceptor in an arcuate path over the arcuate surface, and abrasive means adapted to to contact and remove substantially all of the photoconductive layer from the substrate.

12 Claims, 3 Drawing Sheets

FLEXIBLE BELT RECLAIMING

This is a continuation, of application Ser. No. 07/815,795, filed Jan. 2, 1992, now abandoned.

BACKGROUND OF THE INVENTION

This invention relates in general to electrophotography and more specifically, to apparatus and processes for reclaiming flexible metal belt substrates from electrophotographic imaging members.

In the art of electrophotography a flexible belt photoreceptor may be used in cyclic electrophotographic imaging systems to form visible toner images which are transferred to receiving members. In one well known embodiment, these belts comprise a flexible metal belt substrate, an optional intermediate adhesive layer and one or more photoconductive layers. The photoconductive layers may comprise organic and/or inorganic material. A common inorganic photoconductive layer comprised selenium alloys. These alloys contained selenium and arsenic and/or tellurium with or without halogen dopants. The flexible metal belt substrate can be made of any suitable metal such as nickel, stainless steel, and the like.

Attempts have been made to cycle the materials from spent flexible belt photoreceptors because of the value of the components therein, the difficulty of safely disposing of these materials if not recycled, and the desire to conserve a material that is not plentiful. These attempts include techniques such as rapidly propelling plastic beads against the photoconductive coating on the metal belt substrate to physically remove selenium or selenium alloy coatings. Unfortunately, difficulties have been encountered in separating selenium from the plastic beads. Moreover, this technique is not always completely effectively in removing all of the selenium coating. Thus, such physical separation steps were normally followed by chemical washing and buffing. Brass belts supported by stiff drums have been manually beaten with rods. This approach is very inefficient and slow and does not remove all of the photoconductive material from the substrates. This inefficiency requires multiple passes and multiple water stripping stations for adequate throughput and these additional stations take up valuable floor space. Also, high pressure water jets have been used in attempts to remove photoconductive coatings from metal substrates. However, it is difficult to separate the water from the photoconductive material removed from the substrate. Initial separation of the water from the photoconductive material requires centrifuge separation followed by a long residence time in a dryer. Because of the difficulty in removing all of the water from the photoconductive material, the photoconductive material still damp with water and this in turn reduces its value to reclaimers. Further, the photoconductive layer was not completely removed from many substrates. Heating of the substrates at elevated temperatures to remove selenium or selenium alloy coatings has also been tried. However, none of these processes provided a high yield of metal substrates totally free of photoconductive coating material. Since extremely high purity metal substantially free of inorganic contaminants is required for the practical recycling of metal substrate materials such as nickel for reuse in belt electroforming processes, there is a continuing need for an improved technique for reclaiming high purity nickel belt material from flexible belt photoreceptors.

INFORMATION DISCLOSURE STATEMENT

Endo et al. U.S. Pat. No. 3,990,907, issued Nov. 9, 1976—A method is disclosed for removing a selenium photoresponsive layer from a base material of an electrophotographic apparatus. The method comprises the steps of: (1) immersing the drum in a hot fluid such as water, steam, liquid, or vapor trichloroethylene or perchloroethylene; and (2) removing the selenium layer physically using an instrument which will not damage the surface of the metal drum (e.g. see column 2, lines 4–17).

Abe et al. U.S. Pat. No. 4,501,621, issued Feb. 26, 1985—A method is disclosed for removing a selenium layer from a substrate by producing cracks in the layer. The cracks are produced by introducing volume expansive material to expand and thereby dislodge the coating layer from the substrate. Formation of cracks may be done by exposing the selenium layer to ultraviolet rays, thus imposing to the layer increased or reduced pressure giving a shock to or heating or cooling of the layer.

Bixby U.S. Pat. No. 3,837,815, issued Sep. 24, 1974—A method for separating a coating such as selenium from a base material such as a metal electrophotographic plate is disclosed. The method comprises the steps of: (1) rapidly reducing a temperature of the coated base metal to far below the freezing temperature of water; (2) wetting the coated surface of the refrigerated base metal on the coated side of the base material; and (3) applying heat to effect separation of the frozen layer from the base metal, with the coating adhered to a separated frozen layer. The method removes the coating from a metal substrate without harming the surface of the substrate.

SUMMARY OF THE INVENTION

It is, therefore, an object of the present invention to provide an improved photoconductive layer removal system which overcomes the above-noted deficiencies.

It is yet another object of the present invention to provide an improved photoconductive layer removal system which more effectively removes photoconductive material from a flexible substrate.

It is still another object of the present invention to provide an improved photoconductive layer removal system which is mechanically simple.

It is another object of the present invention to provide an improved photoconductive layer removal system which occupies very little space.

It is yet another object of the present invention to provide an improved photoconductive layer removal system which is simple to maintain.

It is still another object of the present invention to provide an improved photoconductive layer removal system which reclaims components for recycling.

It is another object of the present invention to provide an improved photoconductive layer removal system which reclaims substrates for reuse without additional processing of the substrate.

The foregoing objects and others are accomplished in accordance with this invention by providing a separation process comprising providing a flexible belt photoreceptor comprising a photoconductive layer on the outer surface of a flexible metal belt substrate, the photoconductive layer comprising amorphous selenium or selenium alloy, transporting the substrate through an arcuate path having a small radius of curvature to apply stress to the photoconductive layer, and abrasively removing substantially all of the selenium or selenium alloy remaining on the substrate. This process may be carried out in an apparatus which includes at least one member having an arcuate surface with a small radius of curvature, means to transport the belt photoreceptor in an arcuate path over the arcuate surface, and fibrous means adapted to to contact and remove substantially all of the photoconductive layer from the substrate.

BRIEF DESCRIPTION OF THE DRAWINGS

A more complete understanding of the process of the present invention can be obtained by reference to the accompanying drawings wherein.

These figures merely schematically illustrate the invention and are not intended to indicate relative size and dimensions of the photoconductor layer removal device of this invention or components thereof.

DETAILED DESCRIPTION OF THE DRAWINGS

Figure 1:
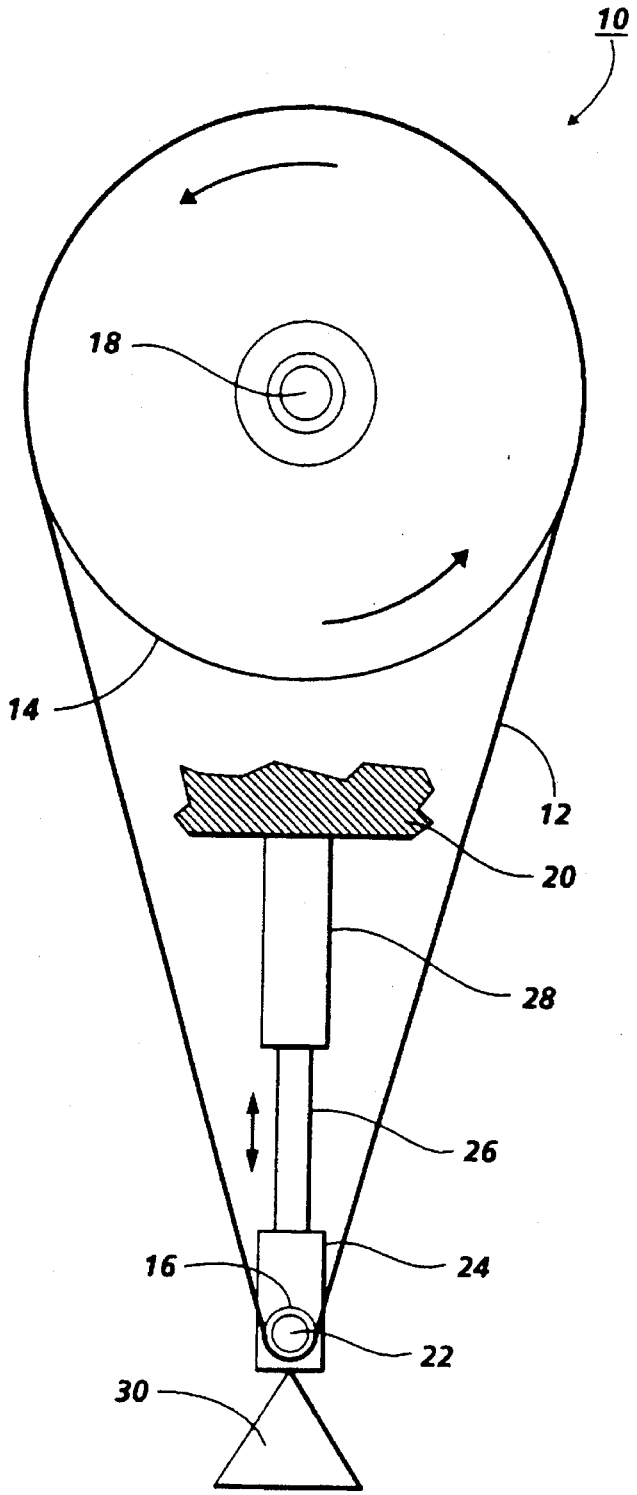
FIG. 1 is a schematic sectional view in elevation of one embodiment of a photoconductor layer removal device of this invention.

Referring to FIG. 1, a photoconductor layer removal device 10 is shown which processes a flexible belt photoreceptor 12 comprising a photoconductive layer on the outer surface of a flexible metal belt substrate. Belt photoreceptor 12 is supported by cantilevered large diameter rotatable drum 14 and cantilevered small diameter roller 16. Large diameter rotatable drum 14 is supported by shaft 18, one end (not shown) of which is journaled in a bearing (not shown) mounted in frame 20. Shaft 18 is rotated by any suitable and conventional drive means (not shown) such as an electric motor coupled to support shaft 18. Small diameter roller 16 is freely rotatable around a support shaft 22 which is secured to a reciprocatable member 24. Although shaft 22 is illustrated as a cantilevered from reciprocatable member 24, greater support against deflection can be achieved when reciprocatable member 24 is bifurcated to support both ends of support shaft 22. Reciprocatable member 24 is mounted on reciprocatable shaft 26 of a two way acting air cylinder 28. If desired, any other suitable means such as solenoids, cams and the like may be utilized instead of the air cylinder. Two way acting air cylinder 28 is connected through suitable and conventional control valves (not shown) to an air supply. Retraction of shaft 26 toward air cylinder 28 allows belt photoreceptor 12 to be mounted on or removed from around drum 14 and roller 16. The triangle 30 represents any suitable member which abrasively removes photoconductive material carried on the outer surface of flexible belt photoreceptor 12. This member may comprise, for example, a stiff brush, a nozzle which directs rapidly moving carbon dioxide pellets against flexible belt photoreceptor 12, or other suitable means to abrade the photoconductive layer.

Figure 3:
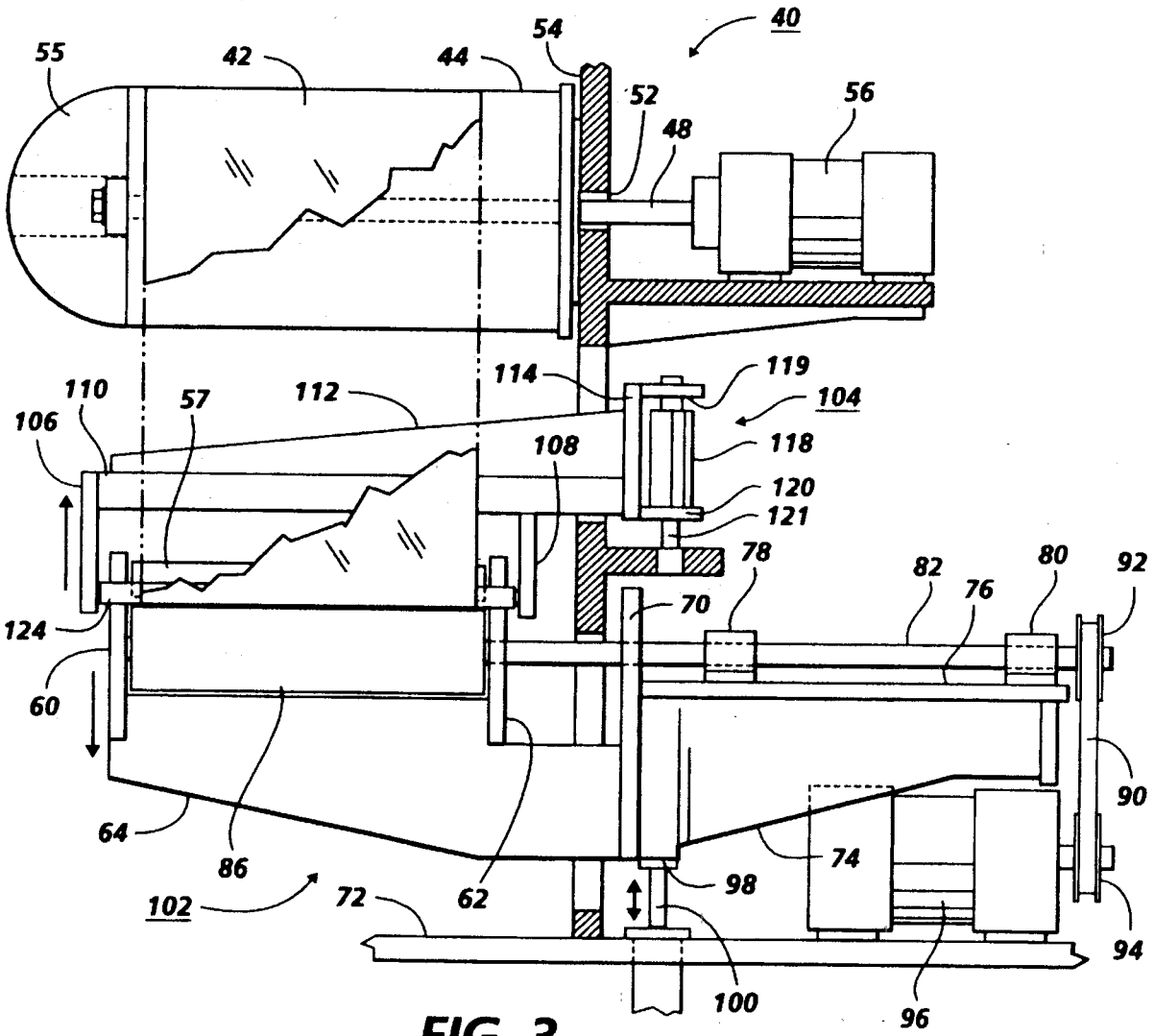
FIG. 3 a schematic sectional side view of the embodiment shown in FIG. 2.
Figure 2:
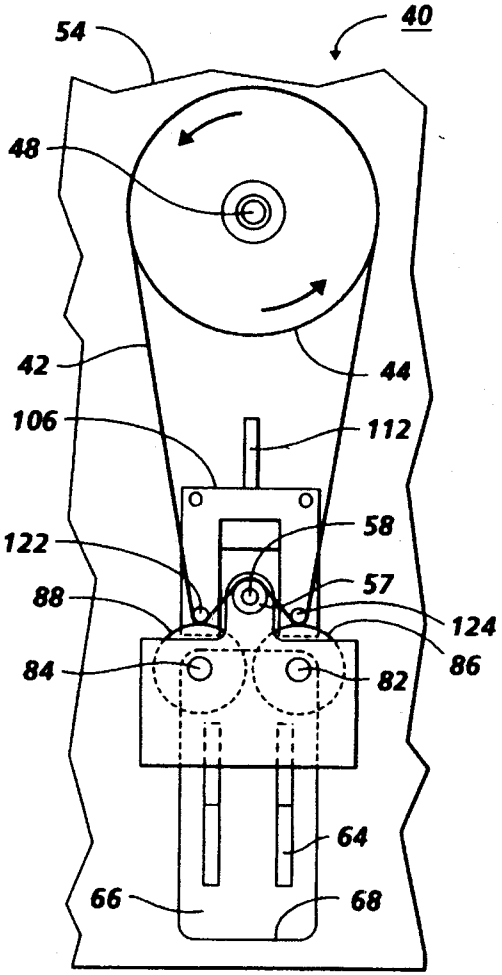
FIG. 2 is a schematic sectional view in elevation of another embodiment of a photoconductor layer removal device of this invention.

Referring to FIGS. 2 and 3, another embodiment of a photoconductor layer removal device 40 is shown which processes flexible belt photoreceptor 42 comprising a photoconductive layer on the outer surface of a flexible metal belt substrate. Belt photoreceptor 42 is supported in part by cantilevered large diameter rotatable drum 44. Large diameter rotatable drum 44 is supported by shaft 48, one end of which is supported in a bearing 52 mounted in frame 54. A dome shaped member 55 is mounted on the other end of shaft 48 to facilitate mounting or removal of belt photoreceptor 42 from drum 44. Shaft 48 is rotated by any suitable and conventional drive means such as an electric motor 56 coupled to shaft 48.

Small diameter tension roller 57 is mounted on and freely rotatable around a support shaft 58 which is secured at each end to vertical end plates 60 and 62 which are welded to vertical reciprocatable guide plates 64 and 66. Reciprocatable guide plates 64 and 66 extend through opening 68 in frame 54 and are welded to vertical plate 70. The vertical edges of plate 70 are supported by and slide in a vertical direction in conventional grooved or slotted vertical tracks of vertical support members (not shown) which are secured to base 72. A pair of spaced apart vertical plates (only plate 74 is visible) are welded to vertical plate 70 and a horizontal plate 76 is welded to plates 70 and 74 and the twin (not shown) of plate 74. Plate 76 carries bearing blocks 78 and 80 for rotatable shaft 82 and another pair of bearing blocks (not shown) for rotatable shaft 84. Shafts 82 and 84 extend through end plate 62 and support and rotate cylindrical brushes 86 and 88. Mounted at the opposite ends of shafts 82 and 84 are pulleys (only pulley 90 is shown). These pulleys are rotated by a belt 92 which is in turn rotated by another pulley 94 driven by electric motor 96 fastened to base 72. Thus, activation of motor 96 causes rotation of cylindrical brushes 86 and 88. If desired, an optional idler pulley (not shown) supported by suitable means fastened to base 72 may be utilized with belt 92 to help retain belt 92 in pulley 90, the twin of pulley 90 and pulley 94. A pair of two way acting air cylinders (only 98 is shown) are secured to vertical plates 74 and its twin (not shown), respectively. Two way acting air cylinder 98 and its twin are connected through suitable and conventional control valves (not shown) to a common air supply. Shaft 100 protruding from air cylinder 98 and an identical shaft protruding from the twin of air cylinder 98 are reciprocated by air cylinder 98 and its twin, respectively. The combination of vertical end plates 60 and 62, guide plates 64 and 66, vertical plate 70, spaced apart vertical plates (only plate 74 shown), and horizontal plate 76 make up reciprocatable carriage assembly 102. Thus, by activating or inactivating air cylinder 98 and its twin, carriage assembly 102 may be raised to bring brushes 86 and 88 and diameter roller 57 into contact with belt photoreceptor 42 or with or lowered to facilitate mounting of belt photoreceptor 42 in or removal of belt photoreceptor 42 from photoconductor layer removal device 40.

A reciprocatable carriage assembly 104 is positioned above reciprocatable carriage assembly 102. Carriage assembly 104 comprises a pair of bifurcated end plates 106 and 108 which are secured to a horizontal plate 110 reinforced by a flange 112, both horizontal plate 110 reinforced by a flange 112 being welded to vertical plate 114. The vertical edges of plate 114 are supported by and slide in a vertical direction in conventional grooved or slotted vertical tracks of vertical support members (not shown) which are secured to extension shelf 116 of frame 54. A two way acting air cylinder 118 is supported by horizontal end plates 119 and 120 welded to plate 114. Air cylinder 118 is connected through suitable and conventional control valves (not shown) to an air supply. Shaft 121 protruding from air cylinder 118 is reciprocated by air cylinder 118. Bifurcated end plates 106 and 108 support small diameter rotatable rollers 122 and 124. Activation or inactivation of air cylinder 118 can lower carriage assembly 104 to bring small diameter rotatable rollers 122 and 124 into contact with the inner side of belt photoreceptor 42 or raised to facilitate mounting of belt photoreceptor 42 in or removal of belt photoreceptor 42 from photoconductor layer removal device 40.

Figure 4:
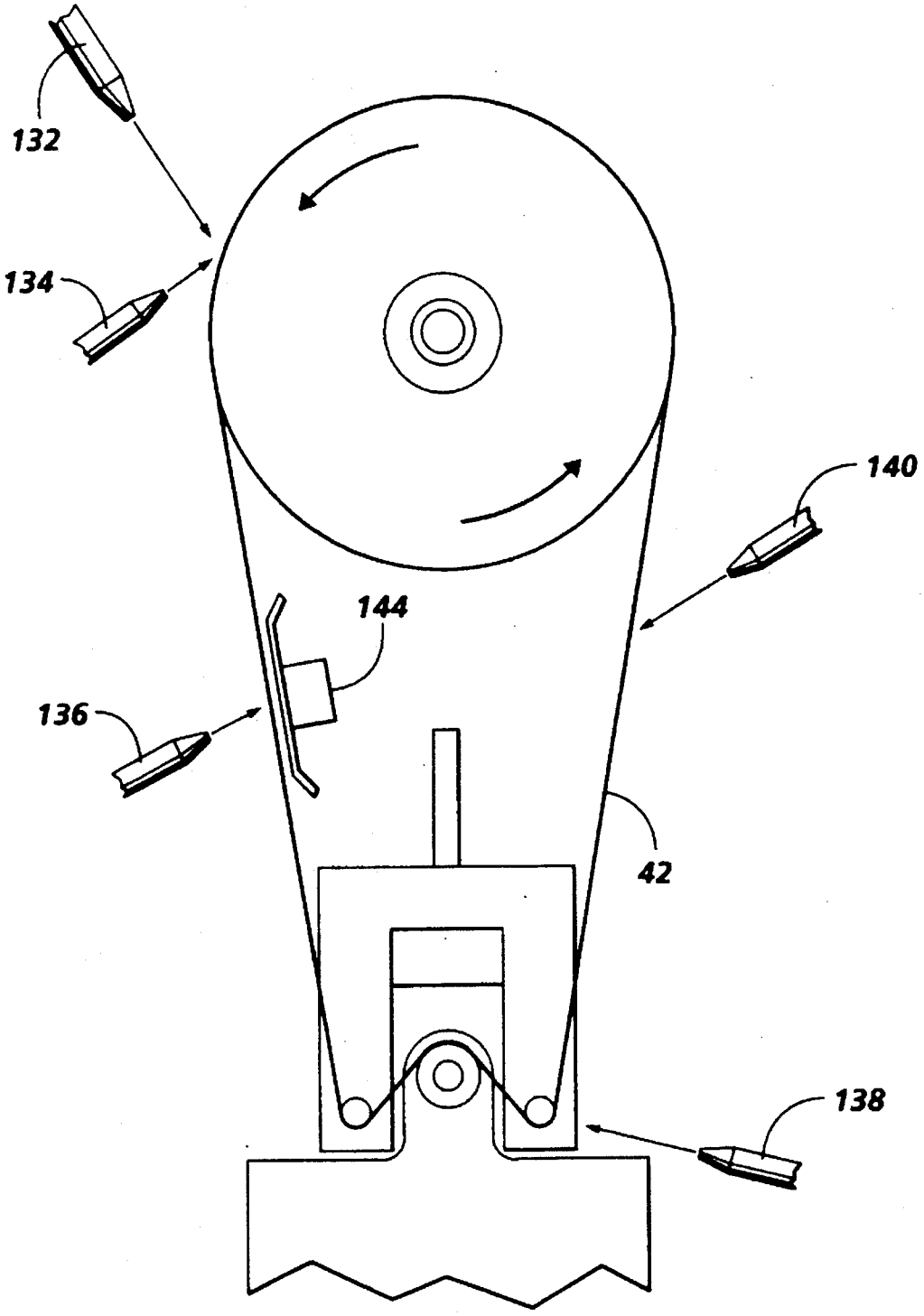
FIG. 4 is a schematic sectional view in elevation showing still another embodiment of this invention.

In FIG. 4, still another embodiment of a photoconductor layer removal device 130 is shown. Photoconductor layer removal device 130 is similar in construction to that illustrated in FIGS. 1 and 2 except that the brushes 86 and 88 are not shown and an alternative or supplemental nozzle means 132, 134, 136, 138, and 140, for projecting jets of carbon dioxide particle against flexible belt photoreceptor 42 are illustrated in various alternative locations and angles. Carbon dioxide pellets are supplied to nozzle means 132, 134, 136, 138, and 140 by any suitable source (not shown) capable of delivering the particles at high velocity. In regions where belt photoreceptor 42 is flat, a backing plate 142 may be optionally be employed to provide support. If desired, an optional means such as transducer 144 may be utilized to impart ultrasonic energy to belt photoreceptor 42 through backing plate 142 or other suitable means to further facilitate removal of the photoconductive material.

Preferably, it is desirable that the flexible belt photoreceptor is heat treated prior to abrasive removal of the selenium or selenium alloy photoconductive material. The heat treatment is preferably sufficient to form blisters in the selenium or selenium alloy layer photoconductive layer. If an adhesive layer comprising a thermoplastic polymer is present in the photorceptor between the substrate and the photoconductive layer, the heat treatment should preferably raise the temperature of the adhesive layer to a temperature at least as high as the glass transition temperature of the thermoplastic polymer. It is believed that the heating step causes the selenium or selenium alloy photoconductive layer to expand at a greater rate than the substrate thereby inducing the formation of blisters in the photoconductive layer. Preferably, sufficient heat is applied until the flexible belt photoreceptor is at least sparcely, but substantially uniformly, covered with blisters in the photoconductive layer. The time and temperature selected for bubble formation varies with the specific selenium or selenium alloy layer material utilized as well as the thickness of the photoconductive layer or layers. Thus, for example, longer times are needed for lower temperatures (if thickness is kept constant) and lower temperatures are needed for thinner photoconductive layers (if time is kept constant). Lower temperatures may be used where the photoconductive coating is relatively thin because there is less mass. A simple visual test to determine the amount of heat and time of application desired is to note the appearance of blisters in the coating. A typical preferred temperature for forming blisters in an arsenic selenium alloy layer is between about 127° C. and about 134° C. for about 50 minutes. Since excessive heat can cause an increase in the adhesion of the selenium or selenium alloy layer to the substrate, it is recommended that for any given type of selenium or selenium alloy photoreceptor, experimental heating runs be conducted at various times and temperatures to determine the time and temperature ranges when at least a few blisters appear. The heating temperature and/or time can then be increased to the point where a significantly increase in adhesion between the photoconductive layer and the substrate is detected. The region between the point where at least a few blisters appear and where adhesion increases significantly is the preferred operating window for the heat treatment. Heating may be accomplished while the photoreceptor belt is mounted in the photoconductor layer removal device or prior to mounting the photoreceptor belt is mounted in the photoconductor layer removal device. However, since the heating process is usually time intensive, it is preferably accomplished prior to mounting the belt in the photoconductor layer removal device. Heating of the photoconductive layer may be effective by any suitable means. Typical heating techniques include oven heating, infrared heating, and the like. A circulating of hot air oven is preferred because of the greater throughput rate and more uniform heating of the belts. Since the belts are relatively thin and have a metallic substrate, they tend to cool to ambient temperatures after removal from an oven and prior to abrasion treatment.

After the selenium or selenium alloy layer has been crystallized, it passed around a support having a small radius of curvature and thereafter subjected to an abrasion treatment. Thus, for example, the belt photoreceptor 12 (see FIG. 1) can be mounted on a large diameter rotatable drive roller 14 with a small diameter roller 16 in a retracted position. Preferably, the drive roller 14 is crowned to promote optimum belts tracking. After mounting, the small diameter roller 16 is moved downwardly to its extended position by activation of the two way acting air cylinder 28. Energizing of an electric motor to drive drum 14 causes the belt photoreceptor 12 to be transported around drum 14 and roller 16. Because roller 16 has a small diameter, the selenium or selenium alloy coating is placed under high stress. An abrasive member 30 such as a brush roller is thereafter brushed against the selenium or selenium alloy coating to separate the coating from the substrate. The small diameter roller 16 may then be retracted to permit removal of belt photoreceptor 12.

In a preferred embodiment, the photoconductor coating is initially formed into a convex shape as it is passed around a small diameter rotatable roller 122 (see FIGS. 2 and 3) to place the coating under high tension, thereafter formed into a concave shape as it is transported over small diameter roller 57 to place the coating under high compression and finally formed into a convex shape as it is passed around a small diameter rotatable roller 124 passed over which again imparts a convex bend into the photoconductor coating to place the coating under compression. The sequential formation of convex and concave bends in the photoconductive coating further promotes separation of the coating from the substrate. If desired, the sequential formation of convex and concave bends may be repeated by using additional roller combinations or by merely cycling the belt around the rollers again. The belt is vigorously abraded with a suitable means such as brushes 86 and 88. Preferably, abrasive treatment is applied to the photoconductive layer at the point of maximum bend radius where the coating is under maximum tension such as the embodiments illustrated in FIGS. 1, 2 and 3 because coating removal can be effected with less energy. If desired, the abrasive means may be located downstream from the small diameter support roller.

Generally, the greater the concave bend radius (i.e. the smaller the radius of curvature) imparted to the photoconductive coating, the greater the stress applied to the coating and maximum enhancement of coating separation from the substrate. Similarly, the greater the convex bend radius (i.e. the smaller the radius of curvature) imparted to the photoconductive coating, the greater the compression applied to the coating and the greater the enhancement of coating separation from the substrate. Generally, the diameter of the small support rollers are as small as possible without breakage of the belt or undue deflection or distortion of the roller along the roller axis. Although a stationary guide means having an arcuate surface may be used instead of rollers, the frictional drag on the belt and the high wear of the arcuate surface renders this embodiment less desirable. Typical roller diameters are between about 1.3 centimeters and about 2.5 centimeters, i.e. a radius of curvature of about 0.65 cm and about 1.25 cm. Optimum results are achieved with a diameter between about 1.8 centimeters and about 2 centimeters because a sharp bend is induced into the belt and minimum deflection of the roller occurs. However, smaller diameter rollers may be utilized if one or more suitable back up rollers are positioned to roll against the side of the smaller diameter rollers opposite the side contacting the photoreceptor belt. The back up rollers assist in reducing deflection of the small diameter rollers. Generally, when the diameter of the small roller exceeds about 3.8 cm, i.e. a radius of curvature of 1.9 cm, the ease of coating removal diminishes perceptibly. Deflection of small rollers unsupported by back up rollers become noticable when the diameter is less than about 1 cm i.e. a radius of curvature of 0.5 cm. Generally, deflection of very small diameter rollers is more likely to occur where the roller serves as a backing surface for an abrasive brush on the opposite side of the supported belt. Excessive deflection can adversely affect uniform contact of the brush and the photoconductive layer surface thereby interfere with effective removal of the photoconductor coating.

Preferably, the amount of wrap of the inner surface of the belt around a small diameter support roller is at least about 180° for optimum application of tension to the photoconductive layer.

If desired, at least one tension roller may be utilized between a small diameter support roller (e.g. see FIGS. 2 and 3), between two small support rollers or between a small support roller and a main drive roller to impart a reverse curve to the belt. Such reverse curve places the coating under compression and further reduces the bond between the photoconductive layer and the substrate. The diameter of the tension roller does not appear to be critical and considerable latitude is apparent. The tension roller also assists in establishing uniform tension along the length of the belt thereby minimizing slipping between the belt and the drive roller.

The drive roller may be of any suitable diameter which can drive the belt without slipping. Typical drive roller materials include steel, stainless steel, tool steel, aluminum coated with a resilient material such as rubber, and the like. The drive roller may have an outer surface of any suitable material. Typical small diameter roller materials include steel, aluminum, high strength steel, stainless steel, tool steel, and the like. If desired, the drive roller and/or other rollers may be biased by any suitable technique such as spring loading, air cylinders, gravity weights, magnets and the like to ensure belt tension uniformity by compensating for variations in size from one belt to another.

Abrasive treatment may be imparted to the photoconductor coating by alternative means such as nozzles 132, 134, 136, 138, or 140 (see FIG. 4) for projecting jets of carbon dioxide particle against flexible belt photoreceptor 42. As shown in FIG. 4, the nozzles may be positioned at various locations and angles relative to the periphery of belt photoreceptor 12. The nozzles may be positioned at only a single location or at a plurality of locations. The nozzles may be of any suitable shape. For example, the nozzle may have one or more slots that extend across the width of belt photoreceptor 12 or it can be a scanning nozzle driven by any suitable means such as a ball and screw system, reciprocating air driven piston, and the like Any suitable abrasion applying means may be employed which is capable of vigorously abrading the photoconductive coating. Typical vigorous abrasion means include stiff brushes, carbon dioxide pellets, and the like, and combinations thereof. If desired, a plurality of identical or different abrasive means may be utilized to remove the photoconductive coating from the substrate. Less preferred are abrasion applying means that form a residue or contaminant which require a subsequent operation to separate the unwanted material from the reclaimed components.

Any suitable belt speed may be utilized. The velocity of the belt does not appear to be critical. Generally, the greater the belt velocity, the greater the throughput. Satisfactory results are achieved with belt speeds between about 1 centimeter per second and about 250 centimeters per second. A typical speed is about 12.7 centimeters per second. Generally, the belt is under sufficient tension to minimize slipping of the belt on the drive roller as the drive roller drives the belt one or more small diameter rollers which impart a sharp bend in the belt.

Preferably, contact between the abrasive means and photoconductive layer is relatively uniform across the width of the photoconductive belt.

Any suitable brush periphery speed may be employed. The speed utilized depends to some extent on the pressure applied against the photoconductive layer and whether the direction of travel of the brush bristles is countercurrent or concurrent with the direction of photoconductive layer travel. Typical brush surface speeds range from about 10,000 centimeters per second and about 100,000 centimeters per second where the brush surface is moving in a direction countercurrent to the direction of the belt surface. The brush may be rotated so that its surface is concurrent with the direction of the belt surface. However, in this latter embodiment, there should be a difference in relative speed. A typical brush speed for a 11.1 centimeter diameter brush is between about 1,500 rpm and about 3,000 rpm. Generally, the diameter of the brush does not appear to be critical. However, the tips of the brush should contact the photoconductive coating with minimum flexure of the contacting bristles to ensure optimum removal of the photoconductive coating from the substrate.

The brushes may comprise any suitable stiff bristle material. The brush bristle material should have sufficient thickness to minimize deflection upon contact with the photoconductive layer. Highly flexible materials such as nylon flex excessively when contacted with the belt and merely polish the surface of the coated belt rather than effectively remove the photoconductive layer. Preferably, the length of the bristles are sufficiently short in length so that there is minimum deflection during contact with the photoconductive coating. However, the stiffness of the brush material affects the length desired. Typical bristle lengths are between about 17.5 millimeters and about 19 millimeters. A typical thickness for a steel bristle is about 6.4 millimeters. Undue deflection of the bristle when contacted with the photoconductive surface causes the bristles to flex during cycling and break off due to fatigue. The bristles should be sufficiently thick to resist deflection when contacted with a photoconductive coating layer. Also, the brush bristles should be harder than the selenium or selenium alloy coating material. Typical bristle materials include, for example, steel, stainless steel, brass, monel, nickel, spring steel, and the like. The bristle density on the brush is preferably as high as possible. However, the density should not be so high as to present a solid surface.

If desired, any suitable abrasive powder or paste composition may be applied to the brushes or the belt during cleaning. Generally, embodiments utilizing an abrasive composition is less desirable because the composition tends to contaminate the selenium material removed from the belt substrate. However, materials that can be easily separated from the selenium material by conventional techniques such as burning, differential settling in fluids, difference in solubility, distillation, and the like may be used if desired.

Any suitable nozzle may be utilized to direct the carbon dioxide pellets against the photoconductive layer. The nozzle may comprise any suitable shape of combination of nozzles. Thus, for example, a plurality of nozzles having round openings may be bundled together to form a plurality of streams of carbon dioxide directed against the photoconductive layer. Alternatively, the nozzle opening may have some other suitable shape such as a slot or the like. Moreover, the nozzle or nozzles may be reciprocated to traverse the surface of the belt.

Preferably, the carbon dioxide pellets are in a form of hard particles having a diameter between about 0.5 millimeter and about 2.5 millimeters. These pellets may be formed by any suitable well known process such as by flash evaporation to create carbon dioxide snow particles followed by compression and extrusion through a die ring, crushing, grinding, and the like. Devices for forming and propelling carbon dioxide pellets are well known in the art and are available, for example, from Envvioronmental Alternatives, Inc., Westchesterfield, N.H.; Cold Jet, Cincinnati, Ohio; and Alpheous Cleaning, Cucamonga, Calif. Extruded carbon dioxide material emerging from dies may be formed into particles by any suitable technique such as blasting with a high velocity air stream, conact with rotating slicing blades, and the like. The pellets may be propelled through the nozzles by any suitable technique. Typical means for propelling carbon dioxide pellets is a pressurized fluid such as air, carbon dioxide, nitrogen, and the like. Fluid pressures range from about 40 psi to about 250 psi. Generally, the carbon dioxide particle velocity should be sufficient to dislodge the selenium or selenium alloy from the substrate. Preferably, the particle velocity is between about 75 m/sec and about 305 m/sec. The cold temperatures imparted by the pellets striking the belt sort of enhances separation of the photoconductive layer from the substrate.

Preferably, the path of the carbon dioxide pellets propelled against the surface of the photoconductive coating should be at an angle between about 15 degrees and about 90 degrees with the plane of the coating if the coating is flat or with a tangent to the coating if the surface of the coating is convex. It is believed that an angle of between about 40 degrees and about 50 degrees between the path of the carbon dioxide pellets and the plane of the surface of the photoconductive coating downstream at the point of contact is optimum for removal of the coating.

Abrasion with carbon dioxide pellets may be carried out at room temperature. When carbon dioxide pellets are utilized as one of the abrasive means to remove the coating, the temperature of the belt in a regional contact with the carbon dioxide pellets is very cold. The cryogenic action of this low temperature promotes separation of the photoconductive coating from the substrate. Separation of the coating may be further advanced by utilizing a drive roller containing a large mass of material so that the roller serves as a heat sink to enhance the formation of a temperature gradient between the outer surface of the coating and the interface between the coating and the substrate. The rapid cooling of the photoconductive coating causes it to shrink more rapidly than the substrate to enhance separation of the photoconductive coating from the substrate. Moreover, the rapid drop in temperature causes the photoconductive coating to become more brittle and more susceptible to abrasive removal.

The use of carbon dioxide pellets also eliminates the need for separation of the abrasive material from the photoconductive coating material removed from the substrate. Thus, the removed photoconductive coating is not contaminated and may be more easily recycled for future photoreceptors or other uses that require high purity photoconductive coating materials. This is a distinct advantage over other techniques such as sand blasting, bead blasting, water blasting, or the like.

If desired, the belt may be vibrated to reduce the bonding energy between the photoconductive coating and the substrate. Any suitable means may be utilized impart by vibration energy to the belt. Typical means for parting vibration energy to the belt include, for example, transducers, rapidly rotating cams, particle impingement in unsupported regions of the belt (e.g. see region of nozzle 140 in FIG. 4), eccentric backing rollers, and the like. Generally, vibrational frequencies of between about 2 Hz and about 60 Hz enhance coating separation.

Preferably, the photoconductor layer removal device is enclosed in a housing to minimize migration of selenium or selenium coating particles into the surrounding environment. If desired, the housing may be fitted at its bottom with a receptacle shaped like an inverted cone into which the removed selenium or selenium alloy coating falls. If desired, the coating material that has fallen into the cone shaped receptacle may be removed from the apex of the cone by any suitable vacuum device which carries the material into a cyclone separator where particles can be separated from the entraining air.

Generally, photoconductive belts reclaimed by the system of this invention comprise a metal substrate, and a selenium or selenium alloy layer. Typical selenium alloys include arsenic selenium, tellurium selenium, tellurium arsenic selenium, and the like. Typical metal substrates include nickel, stainless steel, steel, and the like. The photoconductive belts may also contain an organic polymeric adhesive layer between the substrate and the selenium or selenium alloy layer. A typical adhesive layer is disclosed in U.S. Pat. No. 3,713,821, the entire disclosure thereof being incorporated herein by reference. Also, protective organic polymer edge coatings may be used on the belt photoreceptors. The presence of organic materials in the reclaimed material does not appear to adversely affect its reclaim value because it can be readily burned off during reclaim processing.

Any suitable flexible photoreceptor belt comprising a metal substrate and a selenium or selenium alloy photoconductive layer may be reclaimed with the system of this invention. Selenium and selenium alloy photoconductive layers are well known in the art. Typical selenium and selenium alloy photoconductive materials include amorphous selenium, selenium alloys, halogen-doped selenium alloys such as selenium-tellurium, selenium-tellurium-arsenic, selenium-arsenic, and the like. Deposition of selenium and selenium alloy layers onto a supporting substrate is well known in the art and are described, for example, in U.S. Pat. No. 2,803,542; U.S. Pat. No. 2,822,300; U.S. Pat. No. 2,970,906; U.S. Pat. No. 3,312,548; U.S. Pat. No. 3,467,548; and U.S. Pat. No. 3,655,377, the disclosures of these patents being incorporated by reference herein in their entirety. Generally, the thickness of the photoconductive layer is between about 20 micrometers and to about 100 micrometers, but thicknesses outside this range can also be used.

Flexible metal substrates for photoreceptors are also well known in the art. An especially preferred flexible metal substrate for photoreceptors is nickel. Nickel substrates for flexible photoreceptor belts are described, for example in U.S. Pat. No. 3,905,400, U.S. Pat. No. 3,867,510, U.S. Pat. No. 3,844,906, and U.S. Pat. No. 3,799,859, the entire disclosures of these patents being incorporated herein by reference.

An example is set forth hereinbelow illustrative of the compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A flexible photoreceptor belt comprising a flexible nickel substrate, a thin polymer adhesive layer and a selenium alloy photoconductor layer comprising about 97 percent by weight selenium, about 3 percent by weight arsenic and doped with a minor amount of chlorine was reclaimed. The substrate had a thickness of about 130 micrometers and the selenium alloy layer had a thickness of about 60 micrometers. The belt was 41 centimeters wide, and about 160 centimeters in circumference. This belt was heated for about 40 minutes in an air circulating oven maintained at 128° C. Examination of the photoconductor layer showed it contained numerous blisters caused by the heat treatment. After cooling, the belt was mounted in a photoconductor layer removal device similar to that illustrated in FIGS. 2 and 3. Prior to mounting, the carriage carrying the pair of brushes and tension roller was lowered and the carriage carrying the pair of small diameter support rollers was raised by activating the appropriate two way acting air cylinders. The belt was then slid onto the large diameter drive roller. The carriage carrying the pair of brushes and tension roller was then raised and the carriage carrying the pair of small diameter support rollers was lowered by activating the appropriate two way acting air cylinders. This placed the belt under tension and bent the lower section of the belt into a "W" configuration the brushes contacting the outer surface of the belt at the lower bends of the W with virtually no deflection of the contacting bristles. The large diameter drive roller had a diameter of about 30.5 cm, each of the small diameter support rollers had a diameter of 1.9 cm and the tension roller had a diameter of about 5 cm. Each of the brushes had a diameter of about 11.1 cm and carried steel bristles having a length of about 19 mm and a thickness of about 0.5 mm. The large diameter drive roller was rotated in a counterclockwise direction and the brushes were also rotated in a counterclockwise direction. The rate of rotation of the large diameter drive roller was 0.5 rpm to impart a velocity to the belt of 8.7 mm per second. The brushes were rotated at about 20,000 rpm. After the belt was cycled once past the brushes, the carriage carrying the pair of brushes and tension roller was lowered and the carriage carrying the pair of small diameter support rollers was raised by activating the appropriate two way acting air cylinders. The belt was remove from the photoconductor layer removal device and examined. It was completely free of any selenium alloy photoconductor layer material.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A process for removing a photoconductive layer from a substrate comprising providing a flexible belt photoreceptor comprising a photoconductive layer on the outer surface of a flexible metal belt substrate, said photoconductive layer comprising a selenium composition selected from the group consisting of amorphous selenium and selenium alloy, heating said belt photoreceptor until said photoconductive layer forms blisters on said flexible metal belt substrate, transporting said substrate through an arcuate path having a small radius of curvature to apply stress to said photoconductive layer, and abrasively removing substantially all of said selenium composition remaining on said substrate.

2. A process according to claim 1 wherein said substrate is nickel.

3. A process according to claim 1 wherein said photoconductive layer comprises an alloy of selenium and arsenic.

4. A process according to claim 1 wherein said photoconductive layer comprises an alloy of selenium and arsenic doped with halogen.

5. A process according to claim 1 wherein said photoconductive layer comprises an alloy of selenium and tellurium.

6. A process according to claim 1 wherein said radius of curvature is between about 0.5 cm and about 1.9 cm.

7. A process according to claim 1 including supporting said substrate on the outer surface of a small diameter roller as said substrate is transported through said arcuate path and thereafter imparting a reverse curve to said belt.

8. A process according to claim 7 including abrasively removing substantially all of said photoconductive layer remaining on said substrate at a point substantially opposite the side of said belt in contact with said small diameter roller.

9. A process according to claim 1 including abrasively removing substantially all of said photoconductive layer remaining on said substrate with a rotatable brush.

10. A process according to claim 9 wherein said rotatable brush has stiff metal bristles.

11. A process for removing a photoconductive layer from a substrate comprising providing a flexible belt photoreceptor comprising a photoconductive layer on the outer surface of a flexible metal belt substrate, said photoconductive layer comprising a selenium composition selected from the group consisting of amorphous selenium and selenium alloy, heating said belt photoreceptor until said photoconductive layer forms blisters on said flexible metal belt substrate, transporting said substrate through an arcuate path having a small radius of curvature to apply stress to said photoconductive layer, and abrasively removing substantially all of said selenium composition remaining on said substrate with a stream of carbon dioxide pellets.

12. A process for removing a photoconductive layer from a substrate comprising providing a flexible belt photoreceptor comprising a photoconductive layer on the outer surface of a flexible metal belt substrate, said photoconductive layer comprising a selenium composition selected from the group consisting of amorphous selenium and selenium alloy, heating said belt photoreceptor until said photoconductive layer forms blisters on said flexible metal belt substrate, transporting said substrate through an arcuate path having a small radius of curvature of between about 0.5 cm and about 1.9 cm to apply stress to said photoconductive layer, and abrasively removing substantially all of said selenium composition remaining on said substrate.

* * * * *